US005287974A

United States Patent [19]

Buday

[11] Patent Number: 5,287,974

[45] Date of Patent: Feb. 22, 1994

[54] CATALOG HOLDER

[76] Inventor: Gene Buday, 23902 Taranto Bay, Laguna Niguel, Calif. 92677

[21] Appl. No.: 945,002

[22] Filed: Sep. 15, 1992

[51] Int. Cl.[5] ..... A47F 5/00

[52] U.S. Cl. ..... 211/184; 211/43; 211/175

[58] Field of Search ..... 211/43, 184, 175; 108/61

[56] References Cited

U.S. PATENT DOCUMENTS

| | | | |
|---|---|---|---|
| 3,269,558 | 8/1966 | Hess | 211/184 |
| 3,905,484 | 9/1975 | Dean et al. | 211/184 |
| 4,648,515 | 3/1987 | Merritt | 211/43 |
| 4,759,449 | 7/1988 | Gold | 211/43 |

OTHER PUBLICATIONS

Viking Office Supply Catalog (1992), pp. 163–169.

*Primary Examiner*—Robert W. Gibson, Jr.
*Attorney, Agent, or Firm*—Stetina and Brunda

[57] ABSTRACT

A removable, freestanding binder holding assembly is disclosed for segregating binders within existing shelving. The assembly comprises a back panel having a plurality of spaced apertures along the length thereof and a plurality of divider panels detachably engageable with said back panel at alternate locations along the length of the back panel. The divider panels extend orthogonal to the length of the back panel.

4 Claims, 2 Drawing Sheets

FIG. 3
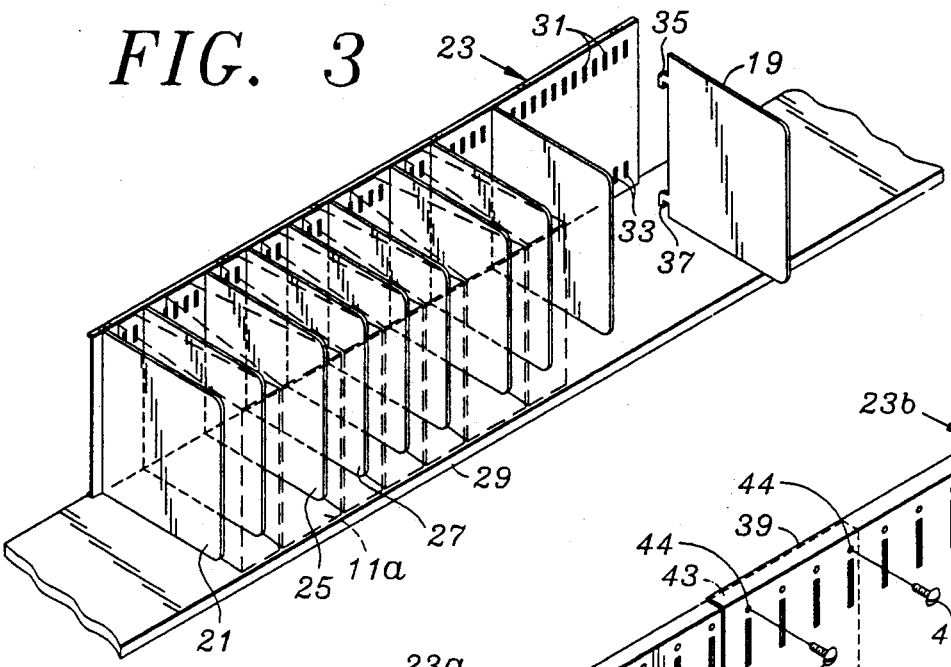
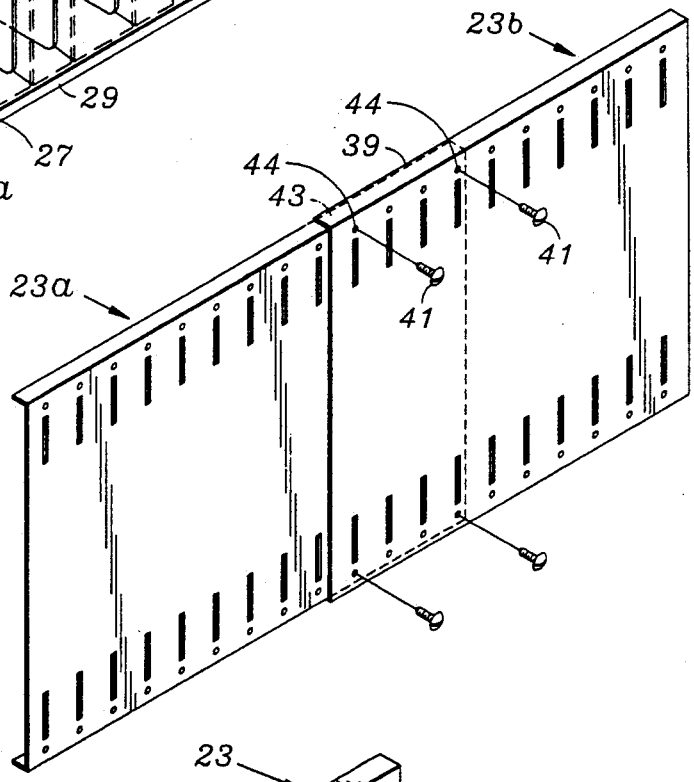
FIG. 5
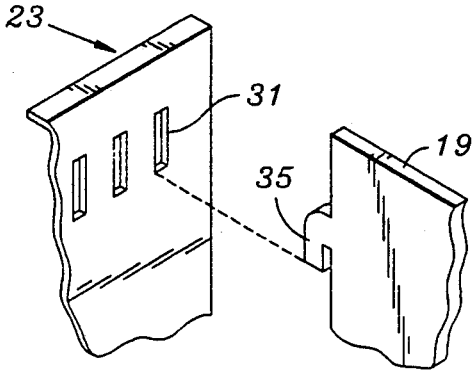
FIG. 4

CATALOG HOLDER

BACKGROUND OF THE INVENTION

The present invention relates to shelving systems and, more particular, to apparatus for supporting and segregating binders and other materials within existing file cabinets.

File cabinets and similar storage devices are typically formed as 3-sided enclosures into which materials to be filed are placed. Frequently, the materials being filed, such as ring binders, have sides that vary in direction in accordance with the volume of documents within the binder. When a plurality of such ring binders are disposed adjacent each other, the result is that the binders become twisted and askew causing difficulty in withdrawing the binders and maintaining proper alignment within the file cabinet.

Additional problems result where the materials being filed, such as folders or magazines, do not have sufficient rigidity to maintain their vertical orientation without the support of adjacent materials. As the adjacent materials are withdrawn, the lighter files will simply lean over and fall, detracting from the appearance and utility of the filing system.

A variety of devices have heretofore been proposed for segregating and supporting filed materials. Various types of self-supporting racks having fixed or adjustable dividers are available for desktop use. Additionally, filing cabinets have been proposed which incorporate slots on the base of each shelf and rear of the cabinet. Dividers may be variably located within the shelves to support and segregate files. Though such shelving systems are useful to segregate and support various size files, they suffer from limitations due to cost and flexibility of use. Filing cabinets incorporating such slots for receiving dividers are substantially more expensive than plain filing cabinets without such slots. Additionally, because the rear slots are in fixed locations, the shelf heights must remain fixed and cannot be varied without sacrificing the ability to segregate and support the files.

The present invention provides an inexpensive and self-supporting system for segregating and supporting various materials such as ring binders and lightweight documents. The present invention provides the functionality of contemporary slotted cabinets to unslotted cabinets, and additionally retains that functionality despite any variation in shelf height.

SUMMARY OF THE INVENTION

A removable, freestanding binder holding assembly is disclosed for segregating binders within existing shelving. The assembly comprises a back panel having a plurality of spaced apertures along the length thereof and a plurality of divider panels detachably engageable with said back panel at alternate locations along the length of the back panel. The divider panels extend orthogonal to the length of the back panel.

The assembly is self supporting and does not require a connection to shelving, cabinetry or adjacent walls. The assembly may be readily installed or removed without the need for any disassembly or customization.

In the presently preferred embodiment the side panels are formed to incorporate engagement members which engage apertures formed in the back panel. However, various other configurations may be used to engage the side panel and back panel.

In the presently preferred embodiment the back panel is provided with a multiplicity of apertures formed at spaced locations along the length of the back panel. The divider panels may be variably spaced in order to accommodate and support binders having different widths.

In a further embodiment of the invention the back panel comprises first and second back panel portions, slidably engageable in order to vary the length of the back panel. Fasteners may be provided to secure the first and second back panel portions together to form the desired combined length.

BRIEF DESCRIPTION OF THE DRAWINGS

FIG. 3 is a perspective view illustrating an exemplary embodiment of a catalog holding system in accordance with the present invention;

FIG. 4 is an enlarged perspective view illustrating joinder of the back panel and divider panel; and FIG. 5 is a perspective view of an alternate embodiment of the invention wherein adjacent back panels are joined to accommodate different shelf lengths.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the structure and operation of the invention in connection with the illustrated embodiments. It is understood, however, that the same or equivalent functions and advantages may be accomplished by different embodiments that are also intended to be encompassed within the spirit and scope of the invention.

Figure 1:
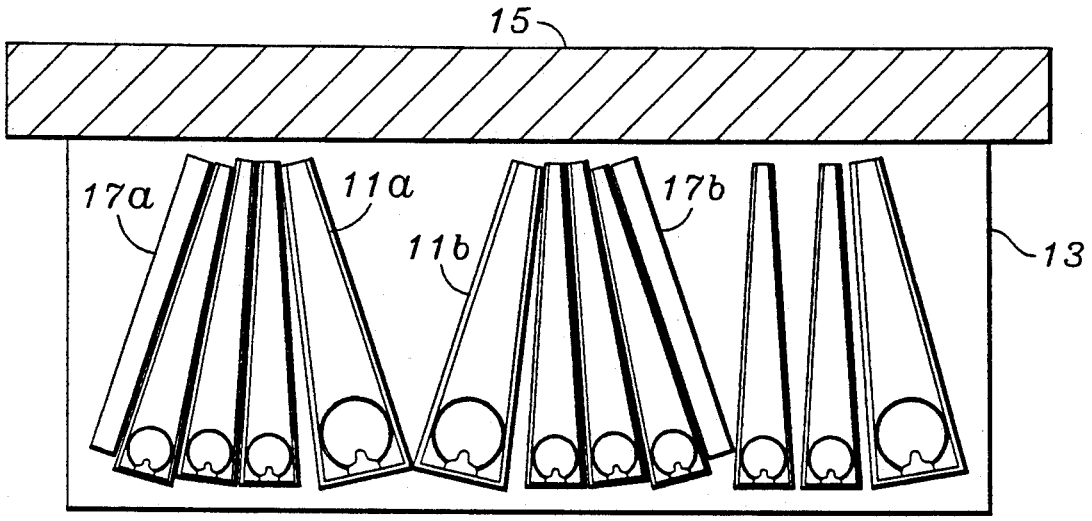
PRIOR ART FIG. 1
FIG. 1 is a top view illustrating shortcomings associated with conventional filing cabinets.

FIG. 1 is a top view illustrating shortcomings associated with conventional filing cabinets. As shown therein, a plurality of 3-ring binders, e.g. 11*a*, 11*b*, are held within the cabinet 13 adjacent the wall 15. In the absence of dividers as described below, the binders 11*a*, 11*b* are free to move until they abut against each other, invariably resulting in an irregular and haphazard arrangement. As a consequence of such movement, removal of the binders from the bookshelf, and return to the same relative position on the bookshelf becomes cumbersome and contributes to a disordered and disheveled filing system. The inclusion of unfastened separators, such as separator 17*a*, 17*b*, while useful to segregate sections of binders 11*a*, 11*b*, etc., does little or nothing to remedy the broader shortcomings relating to the movement of the binders within the cabinet. As described below, the present invention provides a construction which may be utilized in conjunction with existing cabinets, and which remedies the problems with existing cabinet systems as exemplified at FIG. 1.

Figure 2:
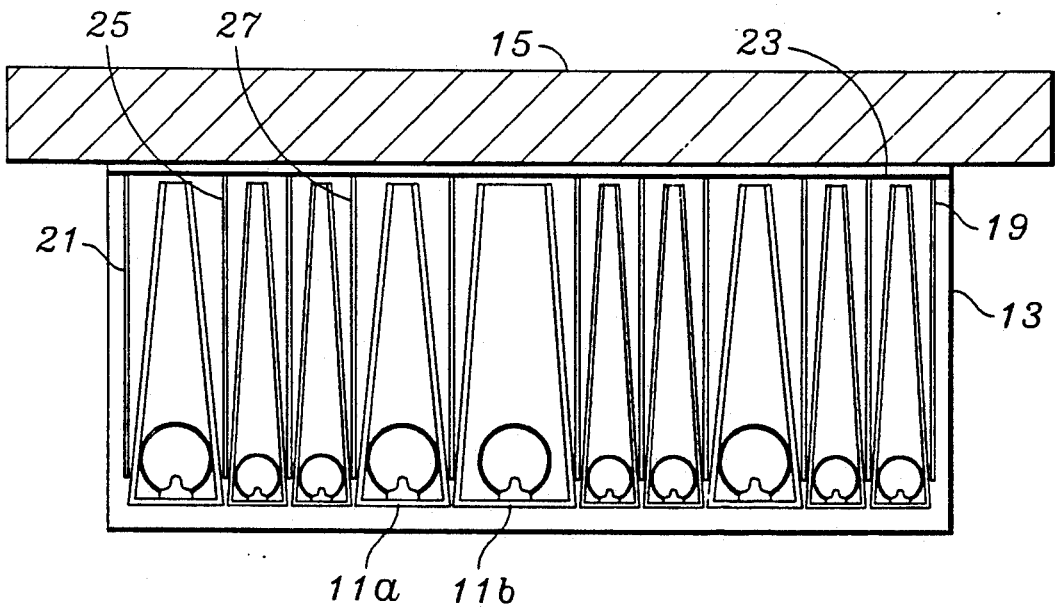
FIG. 2 is a top view illustrating the functionality of a catalog holding system in accordance with the present invention.

FIG. 2 is a top view illustrating the functionality of a catalog holding system in accordance with the present invention. As shown therein, and described further below, the catalog holding system exemplified at FIG. 2, incorporates a back panel 23 which may be inserted within existing cabinets or bookshelves adjacent the rear wall thereof. Secured to the back panel 23 are side panels 19, 21 and divider panels such as 25, 27. The location of the divider panels 25, 27 may be varied along the length of back panel 23 in order to properly segregate and organize catalogs of various sizes and shapes. As will be apparent to those of ordinary skill in the art, the construction of the back panel 23, side panels 19, 21 and divider panels 25, 27, as well as the manner in which those panels are connected, may be varied in the broader aspects of the invention. Moreover, the construction of side panels 19, 21 may be the same as or differ from the construction of divider panels 25, 27.

FIG. 3 is a perspective view further illustrating an exemplary embodiment of a catalog holding system in accordance with the present invention. FIG. 3 provides further detail illustrating exemplary construction of the back panel 23 and of the interconnected panels 19, 21, 25 and 27. As shown therein, back panel 23 is disposed lengthwise along wall shelving 29 in a plane perpendicular thereto. Back panel 23 is provided with a an upper series of apertures 31 and a lower series of apertures 33 adapted to receive engagement members 35, 37 formed upon panels. Upon engagement of the side panels and/or dividers to the back panel 23, the assembly becomes self-supporting and will remain in place upon shelving 29.

As will be apparent to those of ordinary skill, the height and length of the back panel 23 and the side panels and divider panels may be varied without departing from the broader aspects of the present invention. As a practical matter, the assembly will readily support various size binders without conforming to the size of the binders. Thus, smaller panels may be used to accommodate different size shelves and binders. When a user no longer desires to use shelving or cabinet space for filing, the assembly may be readily disassembled and removed and the shelf may be returned to display usage without any remaining holes or impressions on the shelving surface.

FIG. 4 is an enlarged perspective view illustrating the joinder of the back panel 23 and side panel 19. As shown therein, the back panel 23 incorporates a plurality of apertures 31, formed in the shape of slots to receive engagement member 35 formed on side panel 19. As previously noted, different sizes and shapes of apertures and engagement members may be utilized within the broader aspects of the present invention. Moreover, it should be recognized that the assembly may be self-supporting through the interconnection of back panel 23 and dividers 25, 27, without the need for end panels 19, 21.

FIG. 5 is a perspective view of an alternate embodiment of the invention wherein adjacent back panels are joined to accommodate different shelve lengths. The back panel shown therein incorporates portions **23*a* and 23*b* which are slidably engageable and extendable to vary the total length of the back panel. Once the desired length is selected, panels 23*a* and 23*b* may be secured in the desired position by means of fasteners, such as screws 41 inserted into aperture 44. In the embodiment shown in FIG. 5, panel 23*a* is formed to have edge portions such as edge portion 43, adapted to underlie and guide edge portion 39 of panel 23*b***. However, those of ordinary skill in the art will recognize that various alternate constructions may be utilized in order to provide a back panel having an adjustable length. As indicated above, these and other variations are intended to be encompassed within the broader novel aspects of the invention.

What is claimed is:

1. A removable, free-standing binder holding assembly for segregating binders within existing shelving, the assembly comprising:

a back panel having a plurality of spaced apertures along the length thereof;

a plurality of divider panels detachably engageable with said back panel at alternate locations along the length of said back panel, said divider panels extending orthogonal to the length of the back panel;

said back panel comprising first and second back panel portions, said back panel portions being slidably engageable to vary the length of said back panel; and said first and second back panel portions each including a plurality of fastener receiving apertures to facilitate adjustment of the length of the back panel by a plurality of increments corresponding to the distance between adjacent fastener receiving apertures;

said assembly being self-supporting.

2. The assembly as recited in claim 1 wherein said divider panels incorporate at least one engagement member and said back panel incorporates a plurality of apertures for receiving said engagement member.

3. The assembly as recited in claim 1 wherein said divider panels are disposed at spaced locations along the length of the back panel, the distance between adjacent divider panels being variable to accommodate binders having different widths.

4. The assembly as recited in claim 1 further comprising a plurality of fasteners for securing said first and second back panel portions together.

* * * * *